US009682302B1

(12) United States Patent
Lee et al.

(10) Patent No.: US 9,682,302 B1
(45) Date of Patent: Jun. 20, 2017

(54) GOLF SWING PRACTICE APPARATUS AND METHOD OF USE

(71) Applicants: Sung Joo Lee, Los Angeles, CA (US); Joon Hyeong Lee, Campbell, CA (US)

(72) Inventors: Sung Joo Lee, Los Angeles, CA (US); Joon Hyeong Lee, Campbell, CA (US)

( * ) Notice: Subject to any disclaimer, the term of this patent is extended or adjusted under 35 U.S.C. 154(b) by 0 days.

(21) Appl. No.: 15/178,406

(22) Filed: Jun. 9, 2016

(51) Int. Cl.
*A63B 69/36* (2006.01)
*A63B 21/015* (2006.01)

(52) U.S. Cl.
CPC ..... *A63B 69/36* (2013.01); *A63B 69/3661* (2013.01); *A63B 2208/0204* (2013.01)

(58) Field of Classification Search
USPC ..... 473/229, 267, 278, 279, 409; 482/1, 92, 482/109, 121–131, 148
See application file for complete search history.

(56) References Cited

U.S. PATENT DOCUMENTS 1,372,026 A * 3/1921 Hutter ..... A63B 21/0023 482/123
3,843,119 A * 10/1974 Davis ..... A63B 21/154 289/1.2
4,257,592 A * 3/1981 Jones ..... A63B 21/154 24/115 K
4,478,413 A * 10/1984 Siwula ..... A63B 21/153 482/123
5,447,484 A * 9/1995 Chandler ..... A63B 22/0012 482/146
5,524,893 A * 6/1996 McGinnis ..... A63B 21/04 473/229
6,315,701 B1 * 11/2001 Shifferaw ..... A63B 21/012 482/110
7,250,021 B2 * 7/2007 Leight ..... A63B 21/025 482/116
7,364,538 B2 * 4/2008 Aucamp ..... A63B 21/154 482/131
7,946,970 B2 * 5/2011 Garza, Jr. ..... A63B 21/4043 206/315.1
8,088,050 B2 * 1/2012 Aucamp ..... A63B 21/0552 482/126
8,556,785 B1 * 10/2013 Ihli ..... A63B 21/015 482/116
2005/0170937 A1 * 8/2005 van Straaten ..... A63B 21/0552 482/124
2007/0087920 A1 * 4/2007 Dachraoui ..... A63B 21/0552 482/123

OTHER PUBLICATIONS https://youtu.be/yke-dxCC9kw, Published on Oct. 2016.

* cited by examiner

*Primary Examiner* — Nini Legesse

(57) ABSTRACT

A golf swing practice apparatus comprises a clasping mechanism; a cable slidably coupled to the clasping mechanism so that opposing ends of the cable extend from two ends of the clasping mechanism, the cable sized so that each of the opposing ends extends a distance from the clasping mechanism, the distance corresponding to a length of a golf club; and one or more footpads positioned at a predetermined distance from the clasping mechanism. The footpads are positioned at the predetermined distance so as to allow a user to stand upon the footpads and assume a golf swing stance, and to repeatedly rotate his or her shoulders in differing directions about the axis of rotation while grasping the opposing ends with two respective hands, thereby repeatedly sliding the cable in alternating directions through the clasping mechanism.

8 Claims, 2 Drawing Sheets

GOLF SWING PRACTICE APPARATUS AND METHOD OF USE

BRIEF DESCRIPTION

Embodiments of the invention relate generally to golf equipment. More specifically, embodiments of the invention relate to golf swing practice apparatuses and methods of their use.

BACKGROUND

The golf swing or stroke is difficult to master, requiring significant precision, discipline, and consistency. Even slight imperfections or differences in stroke technique may result in large differences in results, often manifesting as poor shot distance, accuracy or ball placement, and the like. In particular, poor swing mechanics may result in loss of distance, hooks, slices, shanks or other undesirable ball trajectories, low round/match scores, and perhaps even injury.

The inherent difficulty of the golf swing means that developing a proper and consistent swing often requires significant practice. Accordingly, it is desirable to develop better apparatuses and methods for practicing a golf swing.

SUMMARY

The invention can be implemented in many ways. In one embodiment, a golf swing practice apparatus for a user having a torso and shoulders rotatable about an axis of rotation extending through the torso, the apparatus comprising: a clasping mechanism; a cable slidably coupled to the clasping mechanism so that opposing ends of the cable extend from two ends of the clasping mechanism, the cable sized so that each of the opposing ends extends a distance from the clasping mechanism, the distance corresponding to a length of a golf club; and one or more footpads positioned at a predetermined distance from the clasping mechanism. The footpads are positioned at the predetermined distance so as to allow the user to stand upon the footpads and assume a golf swing stance, and to repeatedly rotate the shoulders in differing directions about the axis of rotation while grasping the opposing ends with two respective hands, thereby repeatedly sliding the cable in alternating directions through the clasping mechanism.

The golf swing practice apparatus may further comprise a platform having the clasping mechanism and the one or more footpads coupled thereto.

The repeatedly sliding may further comprise repeatedly sliding the cable while maintaining a constant angle between the platform and portions of the cable extending from the ends of the clasping mechanism.

The platform may be a foldable platform. The platform may also be an extensible or collapsible platform.

The cable may comprise one of a rope or a chain.

The clasping mechanism may comprise one of a hook, a pulley, or a gear.

The pulley may be a variable resistance pulley.

Another embodiment may provide a method of practicing a golf swing using a golf swing practice apparatus comprising a clasping mechanism, a cable slidably coupled to the clasping mechanism so that opposing ends of the cable extend from two ends of the clasping mechanism, and one or more footpads positioned at a predetermined distance from the clasping mechanism. The method comprises: for a user having a torso and shoulders rotatable about an axis of rotation extending through the torso, standing upon the one or more footpads; during the standing, grasping the opposing ends of the cable; while performing the grasping, assuming a golf swing stance with the opposing ends of the cable positioned a distance from the clasping mechanism, the distance corresponding to a length of a golf club; and repeatedly rotating the shoulders in differing directions about the axis of rotation while maintaining the grasping, thereby repeatedly sliding the cable in alternating directions through the clasping mechanism.

The golf swing practice apparatus may further comprise a platform having the clasping mechanism and the one or more footpads positioned thereon, and the standing may further comprise standing upon the footpads on the platform.

The repeatedly rotating may further comprise repeatedly sliding the cable while maintaining a constant angle between the platform and portions of the cable extending from the ends of the clasping mechanism.

The repeatedly rotating may further comprise repeatedly rotating the shoulders in differing directions about the axis of rotation while maintaining a position and orientation of the axis of rotation.

Other aspects and advantages of the invention will become apparent from the following detailed description taken in conjunction with the accompanying drawings which illustrate, by way of example, the principles of the invention.

BRIEF DESCRIPTION OF THE DRAWINGS

For a better understanding of the invention, reference should be made to the following detailed description taken in conjunction with the accompanying drawings, in which.

Like reference numerals refer to corresponding parts throughout the drawings.

DETAILED DESCRIPTION

The various Figures are not necessarily to scale. All numerical values are approximate, and may vary. All examples of specific elements as well as their materials and compositions are to be taken as nonlimiting and exemplary only. Other suitable items, materials and compositions may be employed instead.

In one embodiment, the invention involves an apparatus for practicing elements of a golf swing. In particular, one such apparatus has a platform with footpads, and a rope or cable passed through a clasping mechanism that is spaced apart from the footpads by a predetermined distance. To practice a golf swing, a user stands on the footpads and grasps the ends of the cable, assuming a golf swing stance. The user then pivots his or her torso back and forth about an axis of rotation, mimicking the motion of a golf swing. The length of the cable is set so that each half extending from the clasping mechanism approximates the length of a golf club, allowing the user to maintain a proper golf swing stance while pivoting. The user attempts to keep the cable at a fixed angle of inclination from the surface of the platform, which helps him or her maintain the fixed axis of rotation desired in a proper golf swing. Thus, the apparatus allows the user to repeatedly perform and maintain the proper pivoting motion involved in an effective golf swing.

As used herein, the term "golf swing stance" may refer to any stance made in an attempt to perform a golf swing, and may broadly be described as a stance with feet approximately shoulder-width apart, knees bent and back held straight or slightly arched while leaning slightly forward, arms held straight and hands positioned as if grasping a golf club, where the golfer stands and is oriented at a position so as to allow the club to intersect the ball. In particular, the term "golf swing stance" may refer to any stance mimicking what one of ordinary skill in the art would consider a commonly acceptable stance or posture for conducting a golf swing.

Figure 1:
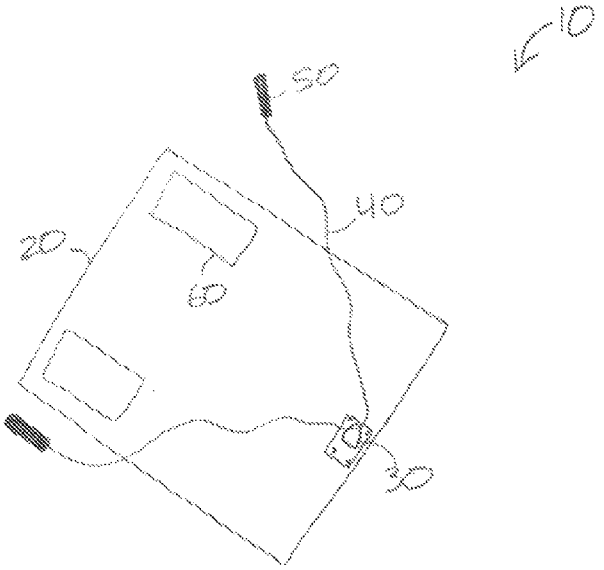
FIG. 1 is an isometric view of a golf swing practice apparatus constructed according to an embodiment of the present invention.

FIG. 1 is an isometric view of a golf swing practice apparatus constructed according to an embodiment of the present invention. Here, a practice apparatus 10 has a platform 20, clasping mechanism 30, cable 40 with handles 50, and one or more footpads 60. The cable 40 is passed through the clasping mechanism 30 so that it can be slid back and forth through the clasping mechanism 30. This allows it to be used as above, simulating the motion of a golf swing.

The platform 20 is a rigid platform sized to allow a human user to stand thereon and mimic a proper golf stance when holding the handles 50 and may measure, for example, three feet by four feet, although any dimensions allowing for assumption of a proper golf stance while standing thereon are contemplated. The platform 20 may be of a fixed size, e.g. a single unitary rigid structure, or may be adjustable in size to allow for differently-sized users. The platform 20 may also be collapsible or foldable for ease of storage or transport. Any configuration or construction of platform 20 is contemplated, so long as it allows for users to assume and maintain a proper golf stance thereon, e.g. allowing footpads 60 to be rigidly or fixedly maintained a set distance from the clasping mechanism 30. In various embodiments, the platform 20 may or may not be present. Thus, for example, the apparatus 20 may omit the platform 20, with the clasping mechanism attached to some other structure such as a door, the floor, or the like.

The clasping mechanism 30 is fixedly attached to the platform 20, such as by screws or bolts, and may be any mechanism allowing cable 40 to be slid (i.e. moved in any manner) therethrough. In one embodiment, the mechanism 30 may simply be a hook, or a closed loop forming an opening for the cable 40, although any mechanism allowing for slidable securing of the cable 40 is contemplated. For example, the mechanism 30 may alternatively be a gear or a pulley. Any such pulley may be a standard rotatable pulley, or may be a variable resistance pulley with a resistance that can be adjusted by the user in known manner.

The cable 40 may be any flexible line. In particular, the cable 40 may be of any configuration and material allowing for repeated pulling back and forth through any of the clasping mechanisms 30. For example, the cable 40 may be a rope made of any material (e.g. natural or synthetic fiber, rubber, braided metal wires, etc.), a chain, or the like. The cable 40 may have handles 50 attached to ends thereof, where these handles 50 may be any handles suitable for gripping by human hands. In some embodiments, the handles 50 may be adjustable along the length of cable 40, so that cable 40 may be effectively shortened or lengthened as desired, to accommodate users of different heights.

One or more footpads 60 may be present. Footpads 60 may be present in any size and number, and may be any areas, specifically designated, marked, or not, for placing a human foot. In one embodiment, footpads 60 may be an area of the platform 20 that is specifically marked for foot placement, and may optionally be coated with a nonslip, nonskid, or roughened surface. Footpads 60 may be located at positions on the platform 20 that allow for proper golf stance. For instance, they may be located so that their center of area is located a distance d (see below) from clasping mechanism 30. In other embodiments, footpads 60 may simply be unmarked and otherwise undesignated portions of platform 20 that are suitable for standing upon. That is, the footpads 60 may or may not be present, and if they are present, may be positioned anywhere on platform 20 or elsewhere.

FIGS. 2A-2C and 3 illustrate an example of use of apparatus 10 for golf swing practice. In operation, a human user stands on platform 20 a distance d from the clasping mechanism, where the distance d is set to correspond to a proper golf swing stance. The distance d may be determined by the user, according to that distance at which he or she believes to be a comfortable or proper distance for executing a golf swing. Alternatively, the distance d may be marked on the platform 20 or footpads 60, with multiple distances d demarcated as, for example, a function of user height.

Figure 2A:
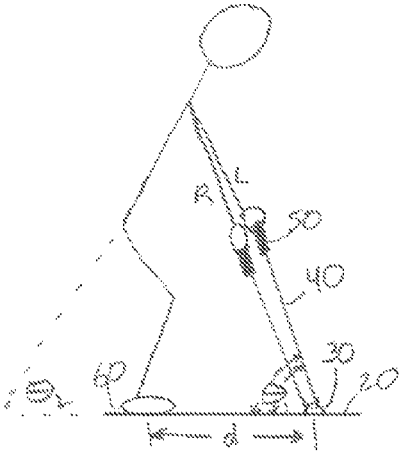
FIGS. 2A-2C is a side view conceptually illustrating golf swing practice performed using the practice apparatus of FIG. 1.

The user then grabs handles 50, one in each hand, and assumes a golf swing stance with knees bent, and back held approximately straight as represented in FIGS. 2A-C and 3. The arms R, L are held so as to generally mimic preparation for a golf swing, with right and left arms R, L extended straight as shown in FIG. 2A. The cable 40 has a length such that the right and left sides (the halves of cable 40 that extend from each side of the clamping mechanism 30) each have a length approximating a golf club. This may be any length, but for example may be in the range of 34 to 46 inches for simulation of adult clubs, or as little as 20 inches for simulation of childrens' clubs. Embodiments of the invention contemplate any length of cable 40 that allows a user of any size to simulate a golf swing.

When a user stands on footpads 60 and assumes a golf swing stance as represented in FIG. 2A, the cable 40 is held at an angle $\theta_1$ with respect to the upper surface of platform 20, as shown. Also, the user's back is held generally straight, with an axis of rotation that forms an angle $\theta_2$ with respect to the upper surface of platform 20, as shown. The axis of rotation is generally thought of as approximating the user's spine, although this is often not precisely correct. Generally, the axis of rotation is simply any axis about which the torso and shoulders rotate during a golf swing, and may be any line (straight or otherwise) passing through and generally bisecting the torso of a user. It is often desirable for the user to stand at distance d such that angle $\theta_1$ approximates a proper or acceptable angle at which a golf club is held in preparation for a golf swing.

Figure 2B:
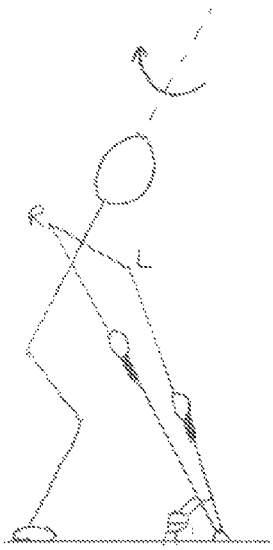
Figure 2C:
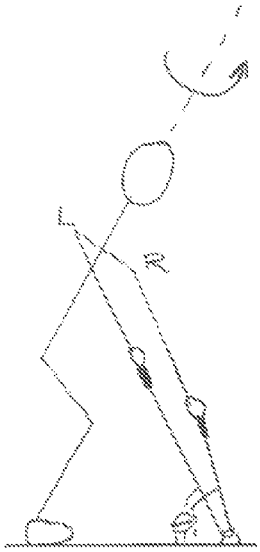

Once assuming the stance of FIG. 2A, the user rotates his or her shoulders back and forth about the axis of rotation, drawing the cable 40 in alternating directions through the clamping mechanism 30, while maintaining or attempting to maintain angles $\theta_1$ and $\theta_2$ constant. In more detail, and as shown in FIGS. 2B and 2C, the user rotates his or her torso in two different directions about its axis of rotation, first rotating so as to pull the right arm R and shoulder back and extending the left arm L and shoulder forward, then reversing direction and rotating so as to pull the left arm L and shoulder back while extending the right arm R and shoulder. These motions are repeated in sequence as often as desired, thus simulating the shoulder and torso rotation of a proper golf swing.

Figure 3:
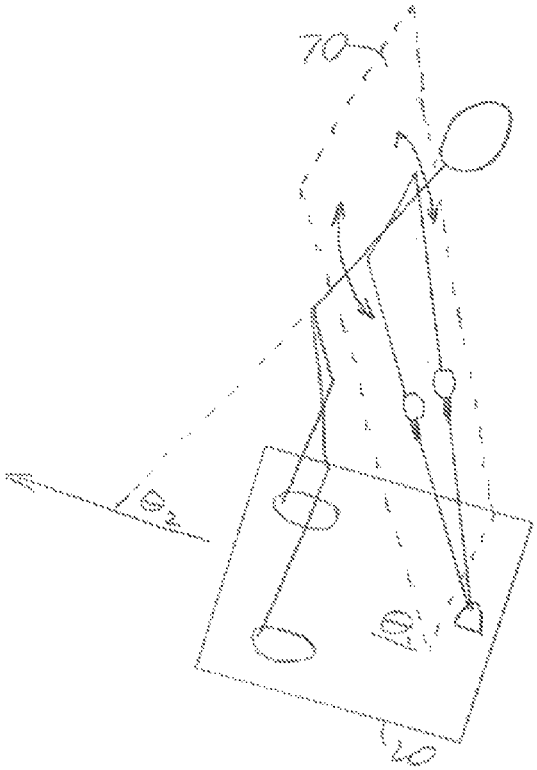
FIG. 3 is an isometric view further illustrating golf swing practice performed using the practice apparatus of FIG. 1.

As the angles $\theta_1$ and $\theta_2$ are held approximately constant, this repeated golf swing practice motion may be thought of as being performed within a plane 70, as shown in FIG. 3. That is, in golf swing practice using apparatus 10, the shoulders and arms are rotated about the torso's axis of rotation, and the cable 40 is slid back and forth through clamping mechanism 30, while all these elements are kept at least approximately within plane 70.

In this manner, the apparatus 10 allows users to repeatedly and properly perform that portion of a golf swing which involves twisting or torsion of the torso, thus providing users a relatively convenient and simple way to practice a significant element of the golf swing without having to go to a golf course or driving range.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. Many modifications and variations are possible in view of the above teachings. For example, the clasping mechanism 30 may be any mechanism that can slidably secure a cable 40 passed therethrough, platform 20 may be any mechanism allowing users to stand a desired distance from clasping mechanism 30, and footpads 60 may be any area upon which a user stands, and indeed may or may not even be present or perceptible. The above described use of apparatus 10 is but one exemplary use, and apparatus 10 may be used in other ways consistent with embodiments of the invention.

The embodiments were chosen and described in order to best explain the principles of the invention and its practical applications, to thereby enable others skilled in the art to best utilize the invention and various embodiments with various modifications as are suited to the particular use contemplated. Additionally, different features of the various embodiments of the present invention, disclosed or otherwise, can be mixed and matched or otherwise combined so as to create further embodiments contemplated by the invention.

What is claimed is:

1. A method of practicing a golf swing using a golf swing practice apparatus comprising a clasping mechanism, a cable slidably coupled to the clasping mechanism so that opposing ends of the cable extend from two ends of the clasping mechanism, and one or more footpads positioned at a predetermined distance from the clasping mechanism, the method comprising:

for a user having a torso, shoulders rotatable about an axis of rotation extending through the torso, and arms extending from the shoulders, standing upon the one or more footpads;

during the standing, grasping the opposing ends of the cable;

while performing the grasping, assuming a golf swing stance with the opposing ends of the cable positioned a distance from the clasping mechanism, the distance corresponding to a length of a golf club; and repeatedly rotating the shoulders in differing directions about the axis of rotation while maintaining the grasping and maintaining the arms straight, thereby repeatedly sliding the cable in alternating directions through the clasping mechanism.

2. The method of claim 1, wherein the golf swing practice apparatus further comprises a platform having the clasping mechanism and the one or more footpads positioned thereon, and wherein the standing further comprises standing upon the footpads on the platform.

3. The method of claim 1, wherein the repeatedly rotating further comprises repeatedly sliding the cable while maintaining a constant angle between the platform and portions of the cable extending from the ends of the clasping mechanism.

4. The method of claim 1, wherein the repeatedly rotating further comprises repeatedly rotating the shoulders in differing directions about the axis of rotation while maintaining a position and orientation of the axis of rotation.

5. The method of claim 1, wherein the standing further comprises standing upon a platform having the clasping mechanism and the one or more footpads coupled thereto.

6. The method of claim 1, wherein the repeatedly sliding further comprises repeatedly sliding one of a rope or a chain through the clasping mechanism.

7. The method of claim 1, wherein the repeatedly sliding further comprises repeatedly sliding the cable in alternating directions through one of a hook, a pulley, or a gear.

8. The method of claim 7, wherein the repeatedly sliding further comprises having a variable resistance applied to the cable.

* * * * *